US010247125B2

(12) United States Patent
Aono et al.

(10) Patent No.: US 10,247,125 B2
(45) Date of Patent: Apr. 2, 2019

(54) FUEL INJECTION VALVE CONTROL DEVICE

(71) Applicant: Hitachi Automotive Systems, Ltd., Hitachinaka-shi, Ibaraki (JP)

(72) Inventors: Toshihiro Aono, Tokyo (JP); Motoyuki Abe, Tokyo (JP); Masahiro Toyohara, Hitachinaka (JP); Osamu Mukaihara, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/534,084

(22) PCT Filed: Dec. 7, 2015

(86) PCT No.: PCT/JP2015/084229
§ 371 (c)(1),
(2) Date: Jun. 8, 2017

(87) PCT Pub. No.: WO2016/104116
PCT Pub. Date: Jun. 30, 2016

(65) Prior Publication Data

US 2017/0335787 A1 Nov. 23, 2017

(30) Foreign Application Priority Data

Dec. 25, 2014 (JP) ..... 2014-261539

(51) Int. Cl.
*F02D 41/20* (2006.01)
*F02D 41/24* (2006.01)
*F02M 51/06* (2006.01)

(52) U.S. Cl.
CPC ..... *F02D 41/2467* (2013.01); *F02D 41/20* (2013.01); *F02D 2041/2003* (2013.01);
(Continued)

(58) Field of Classification Search
CPC ..... F02D 41/20; F02D 41/34; F02D 41/36; F02D 41/2467; F02D 2041/2003; F02M 51/00; F02M 63/00
See application file for complete search history.

(56) References Cited

U.S. PATENT DOCUMENTS 7,945,374 B2 5/2011 Keegan et al.
2004/0025844 A1 2/2004 Rodriguez-Amaya et al.
(Continued)

FOREIGN PATENT DOCUMENTS

JP 2012-527564 A 11/2012
JP 2014-190160 A 10/2014
(Continued)

OTHER PUBLICATIONS

International Search Report (PCT/ISA/210) issued in PCT Application No. PCT/JP2015/084229 dated Mar. 22, 2016 with English translation (5 pages).
(Continued)

*Primary Examiner* — Hieu T Vo
*Assistant Examiner* — Arnold Castro
(74) *Attorney, Agent, or Firm* — Crowell & Moring LLP

(57) ABSTRACT

The purpose of the present invention is to provide a fuel injection valve control device with which variability in the injection amount with respect to drive pulse width can be kept to a satisfactory level in each of a plurality of fuel injection devices. The present invention provides a fuel injection valve control device for controlling a plurality of fuel injection devices each equipped with a valve body and a solenoid for opening the valve body, characterized in that the device is configured such that, a prescribed time after voltage has been applied to the solenoid, a holding current is applied, the prescribed time and the holding current being
(Continued)

corrected for each of the fuel injection devices, on the basis of the operating characteristics of the fuel injection device.

6 Claims, 11 Drawing Sheets

(52) U.S. Cl.
CPC ..... *F02D 2041/2024* (2013.01); *F02D 2041/2055* (2013.01); *F02M 51/0671* (2013.01); *F02M 51/0685* (2013.01)

(56) References Cited

U.S. PATENT DOCUMENTS

2008/0276907 A1* 11/2008 Abe ..... F02D 41/20 123/472
2012/0152207 A1 6/2012 Joos et al.
2014/0041639 A1* 2/2014 Basmaji ..... F02M 51/0689 123/490
2014/0345571 A1 11/2014 Hauser et al.
2015/0377176 A1 12/2015 Hatanaka et al.
2016/0047330 A1 2/2016 Mukaihara et al.
2016/0076498 A1 3/2016 Aono et al.

FOREIGN PATENT DOCUMENTS

JP 2014-214837 A 11/2014
WO WO 2013/191267 A1 12/2013
WO WO 2014/123004 A1 8/2014

OTHER PUBLICATIONS

Japanese-language Written Opinion (PCT/ISA/237) issued in PCT Application No. PCT/JP2015/084229 dated Mar. 22, 2016 (4 pages).
Extended European Search Report issued in counterpart European Application No. 15872685.1 dated Jul. 23, 2018 (12 pages).

* cited by examiner

FUEL INJECTION VALVE CONTROL DEVICE

TECHNICAL FIELD

The present invention relates to a fuel injection valve control device.

BACKGROUND ART

Generally, a fuel injection valve control device is proposed in which variability in injection amount characteristics for each of the fuel injection devices can be suppressed (refer to, for example, PTL 1).

According to PTL 1, a characteristic curve of an injection amount characteristic of a fuel injection valve control device is divided into three regions including a partial stroke region, a transition region, and a full stroke region. Then, in PTL 1, although the partial stroke region and the full stroke region are linear, in particular, control accuracy in the transition region is reduced, and variability between various samples of injection valves having the same structure is significantly increased.

To solve this issue, in the fuel injection valve control device disclosed in PTL 1, it is proposed that the partial stroke region and the full stroke region are used by masking the transition range of the characteristic curve.

CITATION LIST

Patent Literature

PTL 1: JP 2012-527564 W
PTL 2: WO 2013/191267 A

SUMMARY OF INVENTION

Technical Problem

However, in fact, variability is generated also in other regions in addition to the transition region described in PTL 1, and also in a region from the transition region to the full stroke region, variability in injection amount characteristics is generated by such as a bounce when a valve body reaches full stroke.

As described above, variability which can be caused by a bounce in a region from the transition region to the full stroke region is not considered in PTL 1. Therefore, it is difficult that the fuel injection valve control device disclosed in PTL 1 reduces variability in injection amount characteristics for each of a plurality of fuel injection devices in a wide range.

The purpose of the present invention is to provide a fuel injection valve control device with which variability in the injection amount with respect to drive pulse width can be kept to a satisfactory level in each of a plurality of fuel injection devices.

Solution to Problem

In the present invention, a fuel injection valve control device controls a plurality of fuel injection devices, each including a valve body, and a solenoid to open the valve body. The fuel injection valve control device applies a boosting voltage to the solenoid to stop the solenoid and, after a prescribed time, applies a holding current. The prescribed time and the holding current are corrected for each of the fuel injection devices, on the basis of operating characteristics of the fuel injection device.

Advantageous Effects of Invention

According to the present invention, variability in an injection amount with respect to a drive pulse width can be kept to a wide level in each of a plurality of fuel injection devices.

DESCRIPTION OF EMBODIMENTS

A fuel injection valve control device according to an embodiment of the present invention will be described below with reference to the drawings.

First Embodiment

Figure 1:
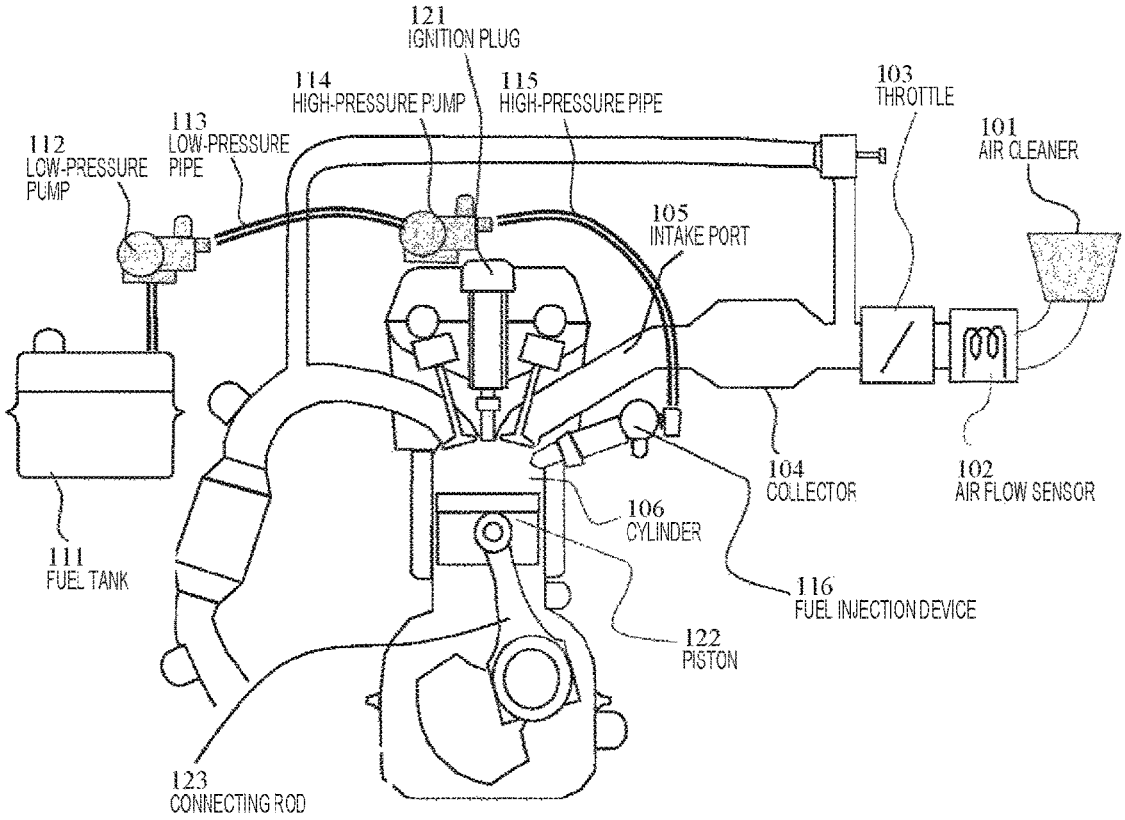
FIG. 1 is a view illustrating an internal combustion engine in which a fuel injection device provided.

FIG. 1 illustrates an internal combustion engine including a fuel injection device controlled by a fuel injection valve control device according to a first embodiment.

The internal combustion engine takes air and fuel in a cylinder 106, explodes the mixture by igniting by an ignition plug 121, and reciprocates a piston 122. This reciprocating motion is converted into a rotary motion of a crank shaft in a link mechanism including such as a connecting rod 123 and becomes a driving force to move a vehicle.

Air is filtered by an air cleaner 101, and a flow rate is adjusted by a throttle 103. Then, the air flows into the cylinder 106 through a collector 104 and an intake port 105. An air flow sensor 102 is provided between the air cleaner 101 and the throttle 103 and measures the amount of air taken into the internal combustion engine.

On the other hand, fuel in a fuel tank 111 is sent to a low pressure pipe 113 by a low pressure pump 112, fuel in the low pressure pipe 113 is sent to a high pressure pipe 115 by a high pressure pump 114, and fuel in the high pressure pipe 115 is kept at a high pressure. The high pressure pipe 115 includes a fuel injection device 116, and a valve body opens when current flows to a solenoid in the fuel injection device 116. While the valve body is opened, fuel is injected.

Figure 2:
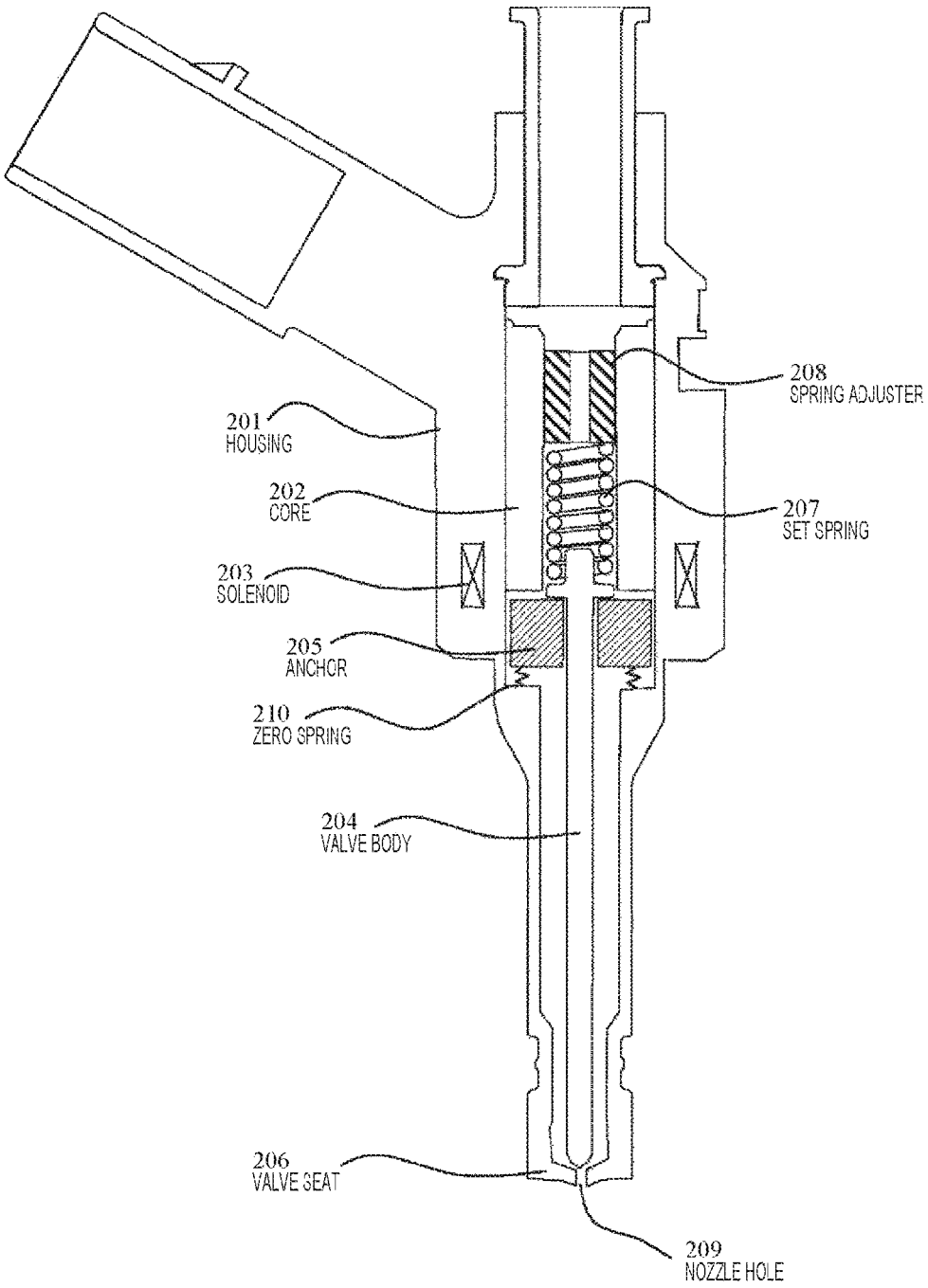
FIG. 2 is a view illustrating a fuel injection device.

FIG. 2 illustrates a structure of a fuel injection device. A member forming an outer side of the fuel injection device is a housing 201. A core 202 is fixed to the housing 201, and also a solenoid 203 is disposed so as to surround a central axis of the fuel injection device. The fuel injection device includes a vertically movable valve body 204. An anchor 205 is disposed so as to surround a periphery of the valve body 204. A set spring 207 to press the valve body 204 toward a valve seat 206 is disposed in an upper portion of the valve body 204. A spring adjuster 208 is fixed to the housing 201 in the upper portion of the set spring 207, and a spring force is adjusted according to a vertical position of the spring adjuster 208. During operation, the inside of the housing 201 is filled with fuel. When current flows in the solenoid 203, the anchor 205 is attracted to the solenoid 203, a lower end of the valve body 204 is separated from the valve seat 206. Then, fuel is injected from a nozzle hole 209 provided on the valve seat 206 which has been closed by the valve body 204. Further, a zero spring 210 is provided between the anchor 205 and the housing 201, and after fuel injection, the anchor 205 is returned to an initial position by a spring balance.

Figure 3:
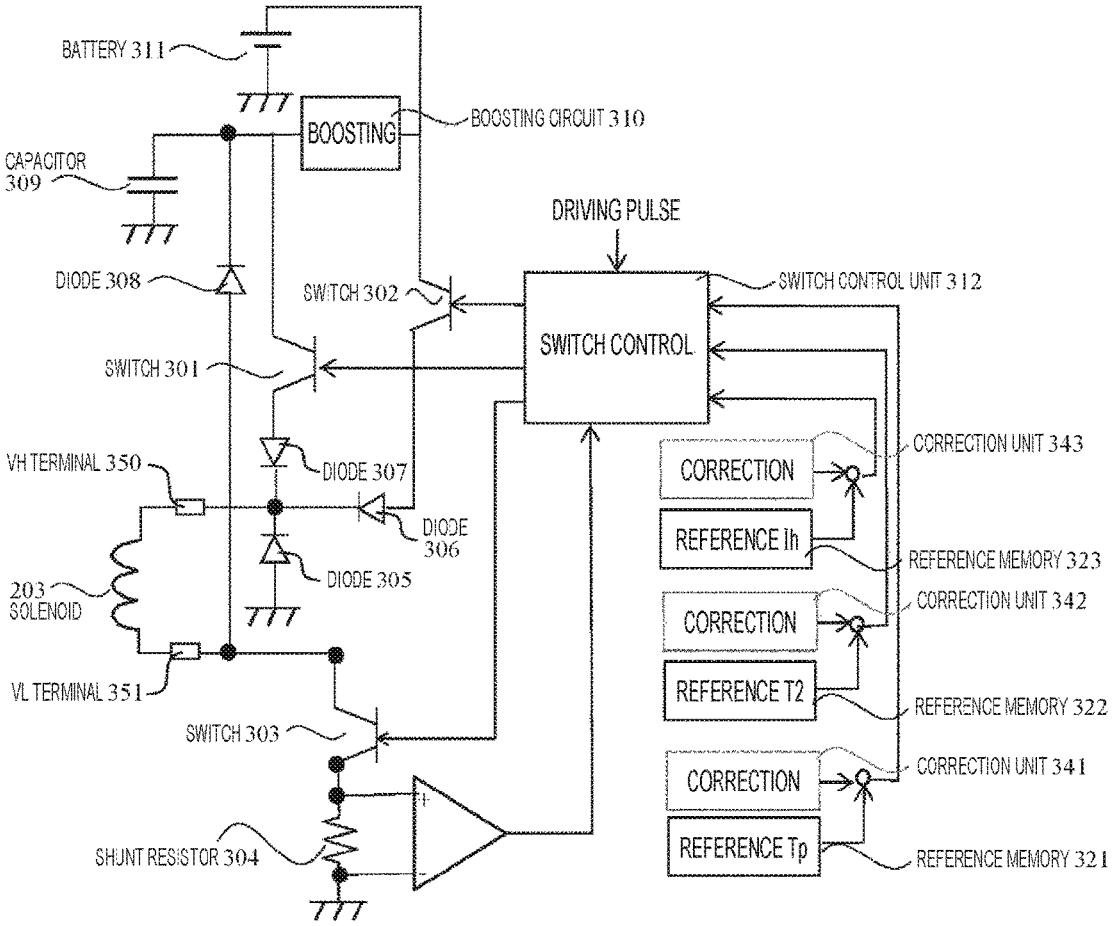
FIG. 3 is a diagram indicating a fuel injection valve control device according to a first embodiment.

The fuel injection device having the above-described configuration is controlled by a fuel injection valve control device illustrated in FIG. 3. The fuel injection valve control device drives the solenoid 203 by using electric power sent from a battery 311. The fuel injection valve control device includes a boosting circuit 310, a capacitor 309, switches 301, 302, and 303, a shunt resistor 304, and diodes 308 and 305. The boosting circuit 310 boosts a voltage of a battery 311. The capacitor 309 stores the boosted voltage. The switch 301 turns on and off between a boosted voltage Vboost and a VH terminal 350 of a solenoid. The switch 302 turns on and off between a battery voltage Vbat and the VH terminal 350 of the solenoid. The switch 303 turns on and off between a VL terminal 351 of the solenoid and a grounding voltage GND. The shunt resistor 304 is disposed between the switch and the GND and generates a voltage proportional to current. The diode 308 flows current from the VL terminal toward between the capacitor 309 and the boosting circuit 310. The diode 305 flows current from the GND to the VH terminal. A zener diode (not illustrated) is disposed between the VL terminal 351 and the diode 308, and circulation easily occurs to the capacitor 309 by increasing voltage of a circulating current.

The boosting circuit 310 increases the battery voltage Vbat, which is generally 12 to 14 V, to the boosting voltage Vboost. The boosting voltage Vboost is, for example, 65 V. The boosting voltage Vboost is set to a higher voltage than the battery voltage Vbat since the valve body 204 overcomes a pressing force by the set spring 207 and rapidly opens. Further, the battery voltage Vbat may be lower than the boosting voltage Vboost as long as the battery voltage Vbat maintains a valve opening state.

Further, the fuel injection valve control device includes reference memories 321, 322, and 323 and a switch control unit 312. The reference memories 321, 322, and 323 store a parameter to control solenoid drive current. The switch control unit 312 turns on and off the three switches based on current measured by a resistor. The reference memory 321 stores a time Tp to apply the boosting voltage Vboost. The reference memory 322 stores a gap time T2 from stopping the boosting voltage Vboost to applying a battery voltage. The reference memory 323 stores a holding current Ih which flows by switching the battery voltage.

Next, the outline of control of a fuel injection device using a fuel injection valve control device will be described with reference to FIG. 4. The lower diagram of FIG. 4 indicates injection amount characteristics of the fuel injection device by a relation between a drive pulse width Ti and a flow rate.

When the drive pulse Ti is sent to a fuel injection valve control device 3 from an ECU (not illustrated), the switch control unit 312 turns on the switches 303 and 301 by synchronizing the rising (Time t1). Then, the voltage Vboost boosted by the boosting circuit 310 is applied between terminals of the solenoid 203, and current gradually starts to flow in the solenoid 203. The current gradually increases, and also a magnetic field generated by the solenoid 203 increases.

As a magnetic attraction force attracting the anchor 205 illustrated in FIG. 2 to the core 202 by the magnetic field increases, the anchor 205 starts to move toward the core 202 (Time t2). A slight gap is formed from an initial position of the anchor 205 balanced by a force of the zero spring 210 to a projection of the valve body 204. When the anchor 205 moves in the gap and collides with the projection of the valve body 204, the valve body 204 starts to be lifted by the anchor 205. At this time, fuel starts to flow out from the nozzle hole 209 (Time t3).

When the boosting voltage application time Tp to apply the boosting voltage Vboost elapses (Time t4), the switches 303 and 301 are turned off. The voltage application time Tp is generally set shorter than the time until when the anchor 205 arrives at the core 202. This is not to unnecessarily increase the power generated when the anchor 205 collides with the core 202.

When the switches 303 and 301 are turned off at the time t4, the current flowing into the GND through the switch 303 flows into the capacitor 309 through the diode 308, and a voltage VL of the LOW-side terminal 351 of the solenoid 203 becomes higher than the voltage VH of the HI-side terminal 350. As a result, a reverse voltage is applied to the solenoid 203. By applying a reverse voltage in this manner, the anchor 205 receives a repulsive force from the core 202. Therefore, the valve body 204 can brake further quickly. This state is maintained until a time t5 after lapse of the gap time T2 from the time t4. However, a reverse voltage is not necessarily applied. Voltage may come to zero by keeping the switch 301 in an OFF state and the switch 303 in an ON state. In addition, a reverse voltage is not necessarily applied in the entire range of the times t4 to t5. For example, a reverse voltage is applied at the time t4 once, and the voltage may be zero after that until the time t5.

At the time t5, the switches 302 and 303 are turned on, and the holding current Ih is flowed by applying the battery voltage Vbat to the solenoid 203. As a result, the valve body 204 and the anchor 205 are continuously in contact with the core 202. At this time, such that a value of the holding current Ih becomes a constant current value on an average, current flowing into the solenoid 203 is calculated from voltage generated to the shunt resistor 304, and the switch 302 is turned on and off.

The switches 302 and 303 are turned off by synchronizing with falling of a drive pulse (Time t6). Then, the current is rapidly damped, and a magnetic attraction force is damped. Consequently, the valve body 204 and the anchor 205 are pressed by a force of the set spring 207 and moved toward the valve seat 206. At this time, while the current is damped, the current flows into the capacitor 309. Therefore, a reverse voltage is applied to the solenoid 203, and when the current is converted to zero, the voltage comes close to zero. Consequently, the valve body 204 reaches to the valve seat 206, and outflow of fuel from a nozzle hole stops (Time t7).

The valve body 204 and the valve seat 206 have slight elasticity. Therefore, the valve body 204 continuously moves toward the valve seat 206 even after the valve body 204 reaches the valve seat 206, and then the valve body 204 and the valve seat 206 start to restore. At this time, the anchor 205 separates from the valve body 204 and continuously moves toward the valve seat 206 by inertia (Time t8). Until the time t8, the set spring 207 force and a fuel pressure are applied to the anchor 205 through the valve body 204. After the time t8, the anchor 205 and the valve body 204 are separated, and these forces are not applied to the anchor 205. Therefore, acceleration of the anchor 205 rapidly decreases. When the acceleration of the anchor 205 changes, a counter-electromotive force generated to the solenoid 203 is changed by a motion of the anchor 205, and a voltage of the solenoid 203 has an inflexion point. After the anchor 205 separates from the valve body 204, the anchor 205 continuously moves toward the valve seat 206 by inertia. However, the zero spring 210 is gradually compressed and then starts to extend. Then, the anchor 205 starts to move toward the core 202, the zero spring 210 extends, and the anchor 205 is returned to an initial position.

With this mechanism, a fuel injection device is controlled and injects fuel of the amount corresponding to the provided drive pulse width Ti. Desirably, air and fuel are taken into an internal combustion engine at a constant ratio to efficiently utilize an exhaust catalyst. Therefore, the drive pulse width Ti is set to a value proportional to a value Qa/Neng/λ obtained by dividing, by a target air fuel ratio λ, a value Qa/Neng obtained by dividing an air quantity Qa measured by an air flow sensor by an engine speed Neng.

By the way, a plurality of fuel injection devices included in one engine has variability in an individual device and has different operating characteristics. Therefore, even if the same drive pulse width Ti is applied to the devices, the amounts of fuel injected from the fuel injection devices disposed to each cylinder are varied. Consequently, fuel with a high air fuel ratio is injected from some cylinders, and fuel with a low air fuel ratio is injected from the other cylinders. It is considered that such variability is caused by various factors including tolerance of parts, a change in the environment where each of the fuel injection devices is disposed, and a difference in elasticity of set springs, and the major factor therein is that a valve behavior is varied by the difference in elasticity of the set springs.

Figure 4:
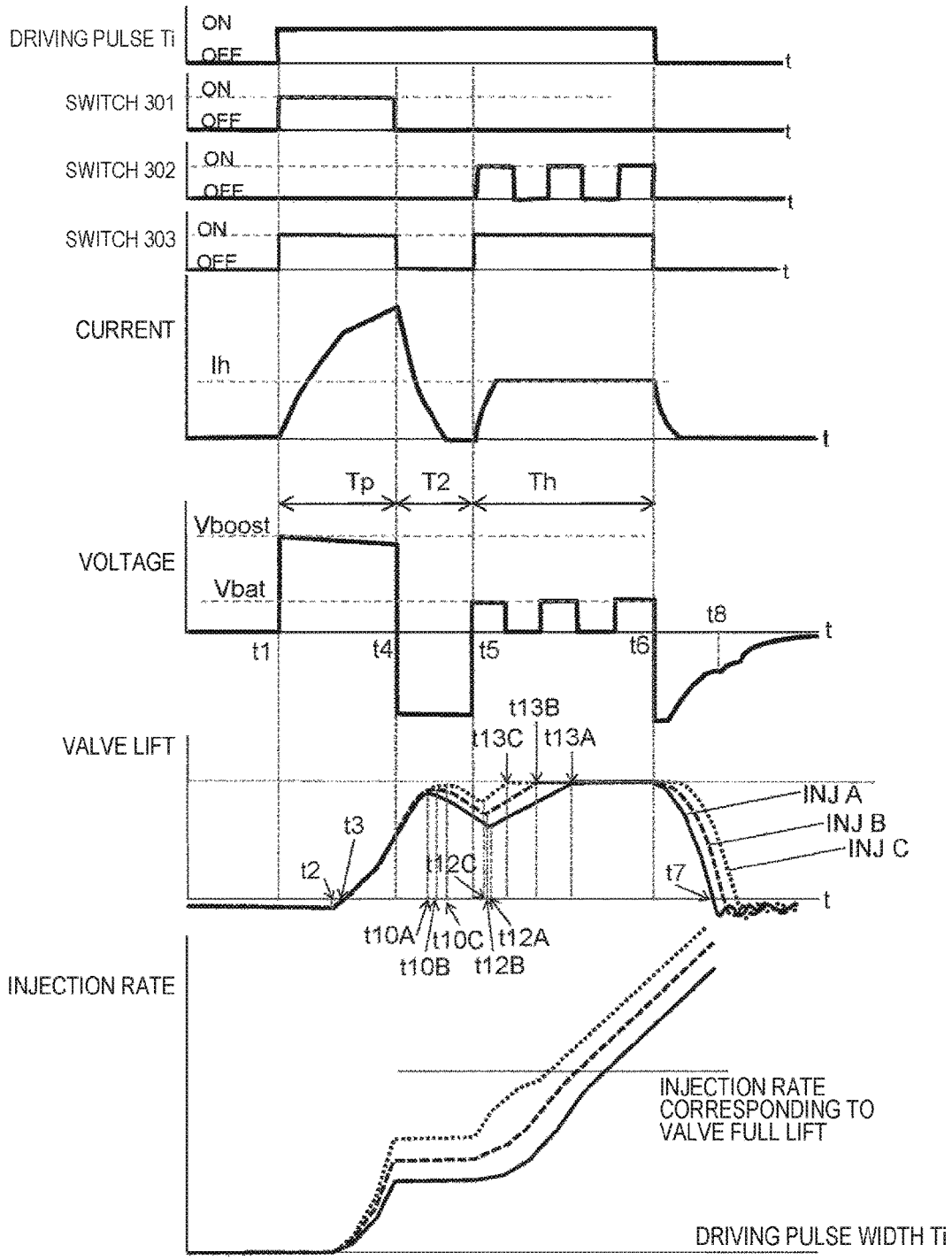
FIG. 4 indicates a control time chart of a fuel injection device by a fuel injection valve control device and indicates injection amount characteristics of the fuel injection device.

FIG. 4 indicates examples of three fuel injection devices INJ A, B, and C which have different injection amount characteristics. Elastic forces of the set springs 207 of the fuel injection devices A, B, and C are strong, normal, and weak, respectively. In the case where the same boosting voltage and holding current are applied to these three fuel injection valves A, B, and C without considering the variability in particular, valve lifts and injection amount characteristics of the fuel injection devices INJ A, B, and C are indicated in FIG. 4 by solid lines, long dashed lines, and short dashed lines.

When a boosting voltage is applied, a valve body is rapidly lifted by a strong cinematic force. Therefore, the difference in elasticity of set springs is not significantly affected to a lift amount of the valve body. On the other hand, after the boosting voltage is applied, the magnetic force lifting the valve body is not much strong in comparison with during applying the boosting voltage. Therefore, the difference in elasticity of set springs remarkably affects the lift amount of the valve body.

Next, in particular, the time t4 and thereafter which is one of the scenes in which the variability is generated will be described. At this time, the magnetic attraction force Fmag generated by the solenoid 203 is gradually reduced. When the Fmag is smaller than a total of a force Fsp of the set spring 207 and a fuel pressure Fpf acting toward the valve seat 206, a valve is changed from rising to falling. This timing depends on the magnitude of the set spring force Fsp and the fuel pressure Fpf. If the set spring force Fsp is large, the valve is rapidly changed from rising to falling (t10A), and if the Fsp is small, the valve is slowly changed from rising to falling (t10C). By stopping drive current, the valve changed from rising to falling is continued to fall until the current is applied again in time t5.

After T2, in other words, at the time t5, the holding current Ih is made to flow. Consequently, a magnetic attraction force exceeds a set spring force Fsp+Fpf again at certain times t12 A, B, and C. This timing becomes slow when the set spring force Fsp of each of the fuel injection devices A, B, and C is large (Time t12A), and the timing becomes fast when the set spring force Fsp is small (Time t12C). The valve body 204 rises again at each of the times t12 A, B, and C.

In addition, a rising speed of a valve increases as a magnetic attraction force by the Ih overcomes the Fsp+Fpf. Therefore, if the Ih is same, the rising speed becomes fast as the set spring force Fsp decreases, and the rising speed becomes slow as the set spring force Fsp increases.

Next, injection amount characteristics of each of the fuel injection devices INJ A, B, and C will be described with reference to the bottom diagram of FIG. 4.

Here, a graph of an injection amount characteristic of a fuel injection device will be described. A horizontal axis indicates a drive pulse width of the injection amount characteristic of the fuel injection device, and a longitudinal axis indicates an injection amount. The drive pulse width corresponds to a drive pulse application time. This injection amount indicates an integral flow rate of all of the period from valve opening to valve closing in the case where the drive pulse is applied over a certain time. Therefore, for example, if a drive pulse is applied over a time period Ty which is from a time tx to a time ty, the injection amount includes a rate of flow flowing until a valve is actually closed after application of the drive pulse is finished at the time ty in addition to a total rate of flow flowing from valve closing to the time ty. Therefore, lift amounts of valve bodies are not significantly varied during the boosting voltage application period Tp. However, injection amounts are varied in reflection of the lift amounts of the valve bodies during the gap time T2 after the application period Tp. Further, during the gap time T2, all of the switches 301 to 303 are turned off even if application of a drive pulse is finished. Therefore, the injection amount is not affected, and a horizontal part appears.

When a lift amount of the valve body 204 is large after the elapse of the voltage application time Tp, the horizontal part of an injection amount characteristic becomes high, and when a slope of the increase of a valve lift from the time t5 to t13 is steep, a slope of the injection amount characteristic until the valve body is fully lifted (time t13 A, B, and C) becomes steep. As described above, it is confirmed that even if the same boosting voltage and holding current are applied, injection amount characteristics of fuel injection devices A, B, and C are significantly varied.

Next, a method for matching the injection amount characteristics by the fuel injection valve control devices according to the embodiment will be described. Specifically, in the fuel injection valve control device, the boosting voltage application time Tp, the gap time T2, and the holding current Ih are corrected. The voltage application time Tp, the gap time T2, the holding current Ih are set according to the set spring force Fsp. In the case where the set spring force Fsp is determined, the set spring force Fsp is input to the fuel injection valve control device in advance.

<Correction of Voltage Application Time Tp>

Figure 5:
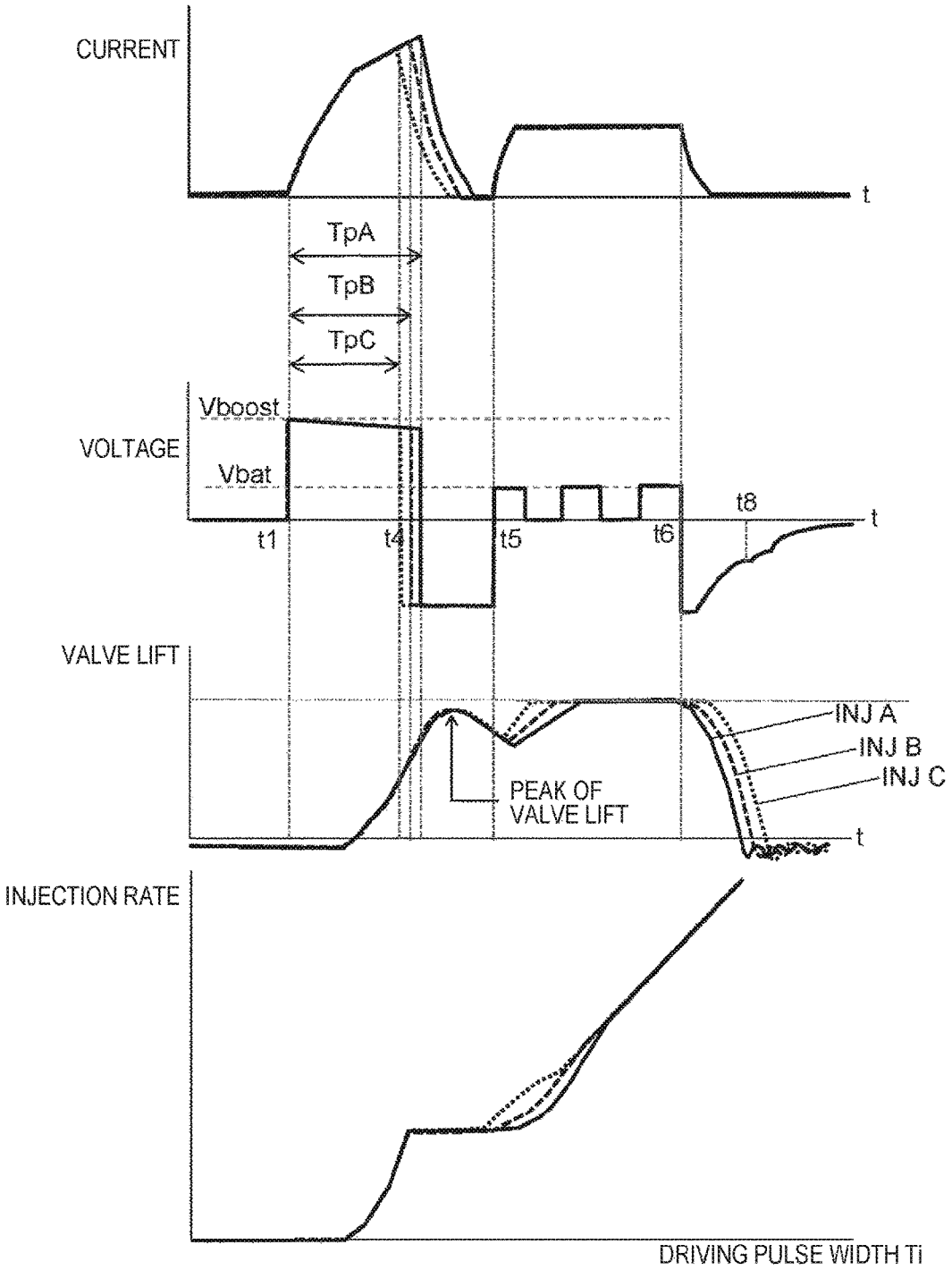
FIG. 5 indicates a time chart to correct a boosting voltage application time and indicates injection amount characteristics of a fuel injection device.

A fuel injection valve control device according to the embodiment includes a voltage application time correction unit 341 as indicated in FIG. 3. Effects of correction by the voltage application time correction unit 341 will be described based on. FIG. 5. FIG. 5 describes the case where the voltage application time Tp is changed for each of the fuel injection devices A, B, and C. As indicated in the upper diagram of FIG. 5, the boosting voltage application time correction unit 341 corrects the voltage application time Tp to a voltage application time TpC which is shorter than a standard in a fuel injection valve C in which the set spring force Fsp is small. Further, a voltage application time with respect to the fuel injection device A in which the spring force Fsp is large is corrected to a voltage application time TpA which is larger than the standard. Peak times of a valve lift are matched as indicated in the central diagram of FIG. 5 by the voltage application time correction unit 341. Further, injection amount characteristics with respect to the drive pulse width Ti are as indicated in the bottom diagram of FIG. 5, and horizontal parts of the injection amount characteristics are matched.

<Correction of Gap Time T2>

Figure 6:
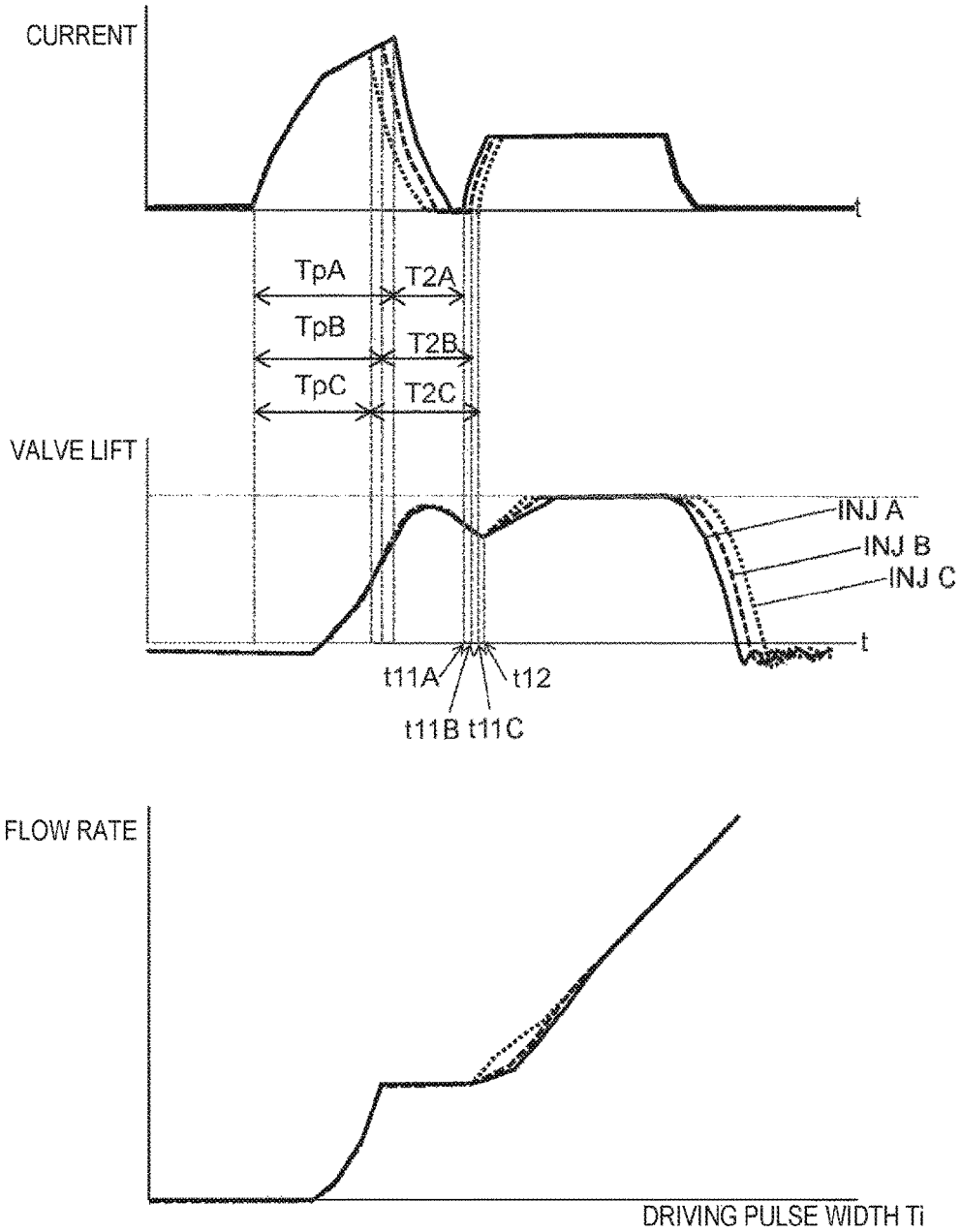
FIG. 6 indicates a time chart to correct a boosting voltage application time and a gap time and indicates injection amount characteristics of a fuel injection device.

As illustrated in FIG. 3, the fuel injection valve control device according to the embodiment includes a gap time correction unit 342 which corrects the gap time T2 from stopping the voltage Vboost to applying a next battery voltage. Effects of the correction by the gap time correction unit 342 will be described with reference to FIG. 6. FIG. 6 describes the case where the gap time T2 is further changed for each of the fuel injection devices A, B, and C in a state in which the voltage application time Tp is already corrected by the above-describe voltage application time correction unit 341.

As indicated in the upper diagram of FIG. 6, the fuel injection valve control device retards the holding current application time t5 to the time t5C with respect to the fuel injection valve C in which the set spring force Fsp is weak (specifically, the gap time T2 from the boosting voltage application end time t4 to the holding current application time t5 is denoted by T2C) As a result, the fuel injection valve control device retards rising of a magnetic attraction force and a timing when the valve rift starts to rise again.

Further, the fuel injection valve control device, also as indicated in the upper diagram of FIG. 6, advances the holding current application time t5 to the time t5A with respect to the fuel injection valve A with the strong set spring force Fsp (specifically, the gap time T2 is denoted by T2A). As a result, the fuel injection valve control device advances rising of a magnetic attraction force and advances a timing when the valve body 204 starts to rise again.

By the gap time correction unit 342, the timings when all of the valve bodies 204 of the fuel injection devices A, B, and C start to rise again are matched as indicated in the central diagram of FIG. 6. Further, injection amount characteristics with respect to the drive pulse width Ti are as indicated in the bottom diagram of FIG. 6, and the injection amount characteristics from a horizontal part to a range in which a flow rate increases are matched.

<Correction of Holding Current Ih>

Figure 7:
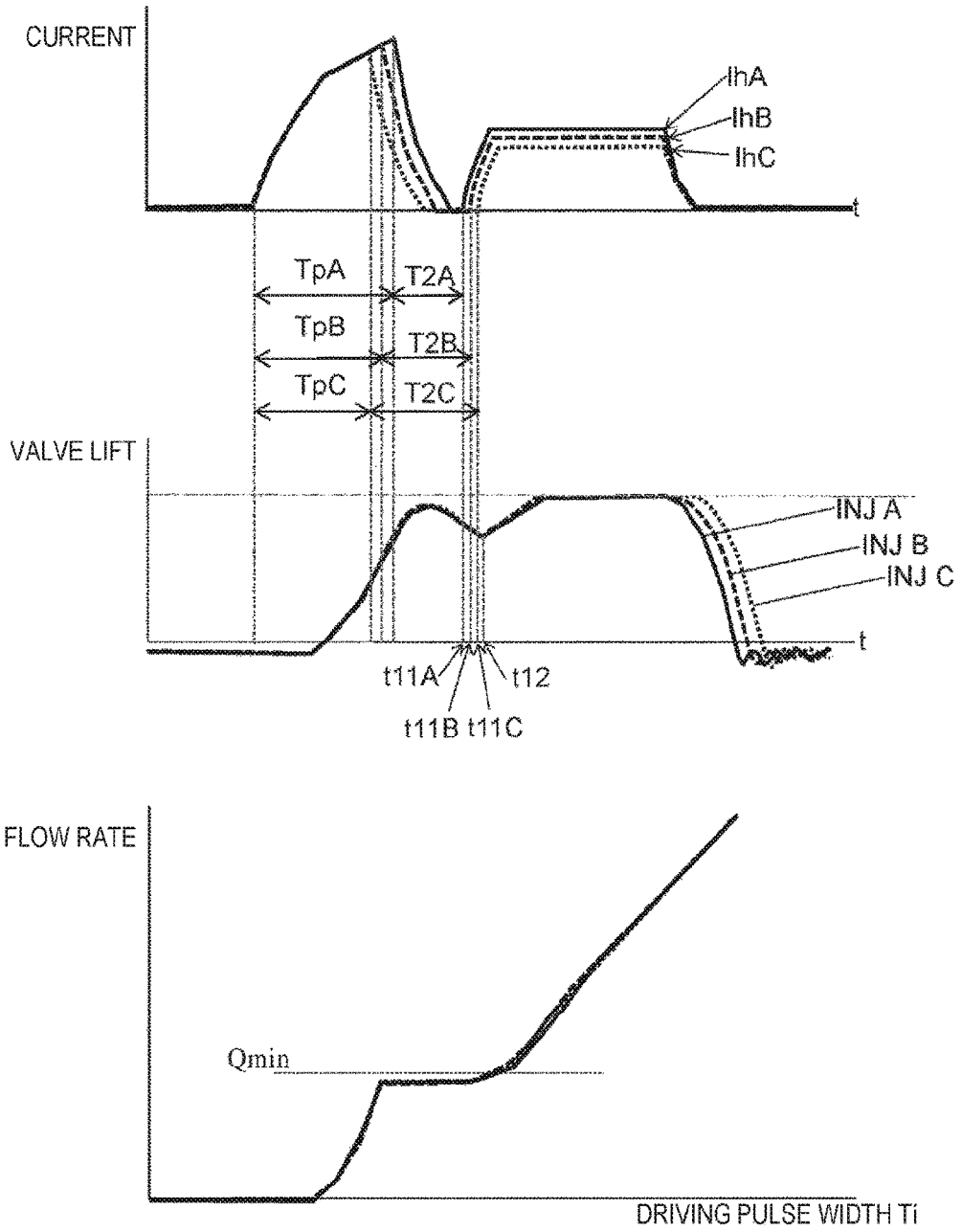
FIG. 7 indicates a time chart to correct a boosting voltage application time, a gap time, and a holding current and indicates injection amount characteristics of a fuel injection device according to a first embodiment.

The fuel injection valve control device according to the embodiment includes a holding current correction unit 343 which corrects the holding current Ih as indicated in FIG. 3. Effects of the correction by the holding current correction unit 343 will be described with reference to FIG. 7. FIG. 7 describes the case where the holding current Ih is further changed for each of the fuel injection devices A, B, and C in a state which the boosting voltage application time Tp and the gap time T2 are already corrected by the voltage application time correction unit 341 and the gap time correction unit 342.

As indicated in the upper diagram of FIG. 7, the fuel injection valve control device corrects the holding current Ih of the fuel injection valve A in which the set spring force Fsp is large to a large holding current value IhA and corrects the holding current Ih of the fuel injection valve C in which the set spring force is small to a small holding current value IhC. Accordingly, as indicated in the middle diagram of FIG. 7, rising speeds (specifically, slope) of the valve bodies 204 from the time when the valve bodies 204 start to rise until the valve bodies are fully lifted are matched. Further, injection amount characteristics with respect to the drive pulse width Ti are as indicated in the bottom diagram of FIG. 7, and shapes of the characteristics are matched. Furthermore, the shapes of the injection amount characteristics are almost straight lines, and slopes of the straight lines can be recognized to match.

As described above, in the fuel injection valve control device, valve behaviors are matched by correcting the voltage application time Tp, the gap time 12, the holding current Ih, and as a result, injection amount characteristics can be matched. In the case of comparing FIGS. 4 and 7, the heights of peaks of the valve behaviors, and timings of temporary falling, and slopes in the case where the values are lifted again after falling temporarily are matched.

According to the fuel injection valve control device according to the embodiment, as indicated in the bottom diagram of FIG. 7, a range available for a fuel injection device can be expanded to the lower limit Qmin line of the injection amount characteristics.

Second Embodiment

When the fuel injection valve control device according to the first embodiment corrects the voltage application time Tp, the gap time 12, the holding current Ih, a set spring force is previously input. A fuel injection valve control device according to a second embodiment corrects them based on a valve behavior in the case where a fuel injection device is actually operated.

Figure 8:
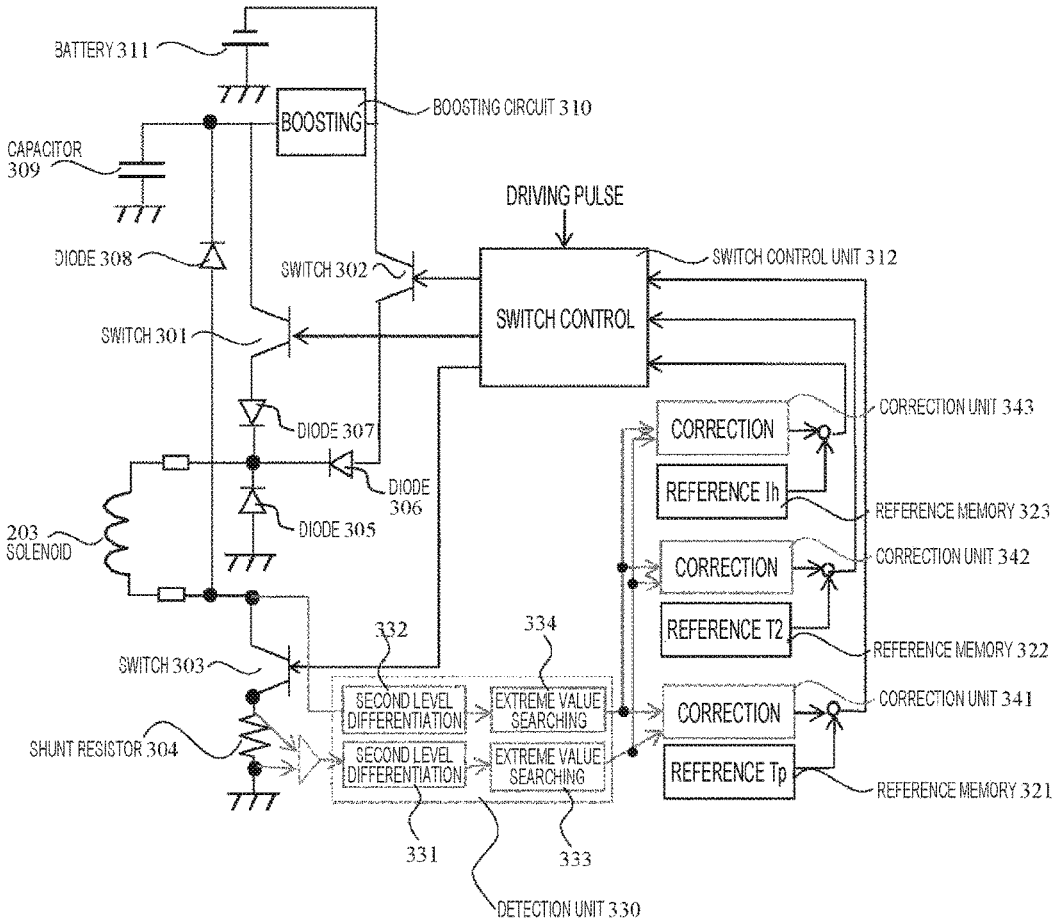
FIG. 8 indicates a fuel injection valve control device according to a second embodiment.

As indicated in FIG. 8, the fuel injection valve control device according to the second embodiment includes a drive voltage second order differential unit 331, a current second order differential unit 332, and peak detection units 333 and 334. The drive voltage second order differential unit 331 and the current second order differential unit 332 second-order differentiate drive voltage and current of a solenoid 203, respectively. The peak detection units 333 and 334 search a timing and a value for taking extreme values of second-order differential values of the current and the voltage.

Figure 9:
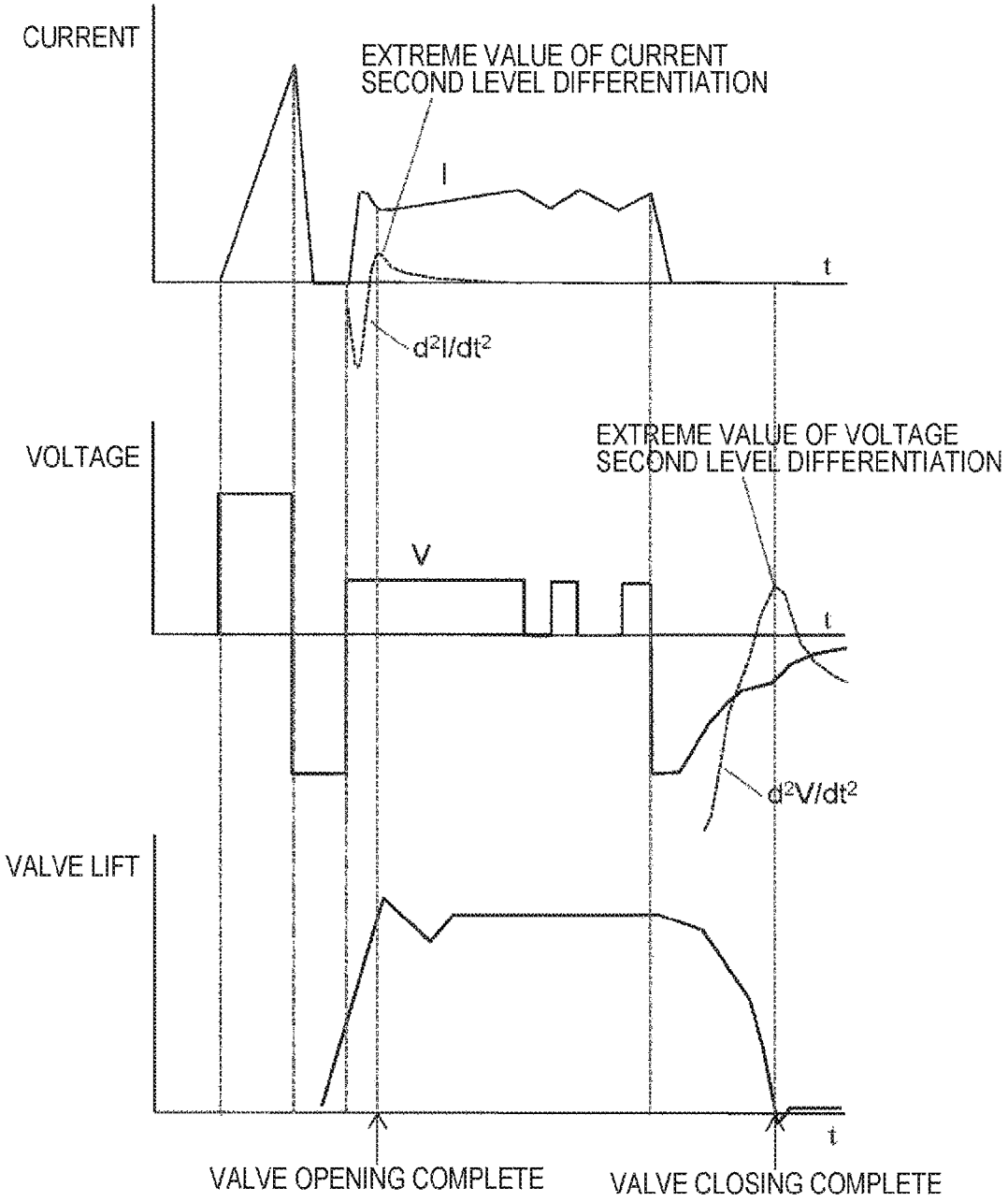
FIG. 9 indicates a control time chart by a fuel injection valve control device and indicates injection amount characteristics of a fuel injection device.

In the case where the fuel injection device is driven at the current indicated in the upper diagram of FIG. 9 and the drive voltage indicated in the middle diagram of FIG. 9, a valve behavior of the fuel injection device is as indicated in the bottom diagram of FIG. 9. Further, a waveform obtained by second-order differentiating the drive current is as indicated by a broken line in the upper diagram of FIG. 9, and it is found that a peak of the second-order differential value corresponds to a valve opening completion timing. Further, a waveform obtained by second-order differentiating the drive voltage is as indicated by a broken line in the middle diagram of FIG. 9, and it is found that a peak of the second-order differential value corresponds to a valve closing completion timing.

In an example of FIG. 9, the anchor 205 is intentionally collided with the core 202 during valve opening, and therefore, a waveform or a valve lift differs from the waveform in such as FIG. 4. This is because a large counter-electromotive force is generated by the intentional collision at a valve closing completion timing, and a second-order differential value can be easily detected.

In general, in a fuel injection device, valve closing is completed fast, and valve opening is completed slowly, in the case where a set spring force is strong. Therefore, the set spring force can be estimated from a valve closing completion timing or a valve opening completion timing. Therefore, the correction unit may store a spring force in advance in some storage unit and may calculate a correction value from a detection result by detecting a valve closing completion timing and a valve opening completion timing.

Further, extreme values of the second-order differential values of voltage and current are proportional to a speed of a valve colliding with a valve seat during valve closing and a speed of an anchor colliding with a stopper at a valve opening completion timing. Therefore, when the extreme value of the second-order differential value of voltage is large, a spring force can be estimated to be large, and when the extreme value of the second-order differential of current is large, the spring force can be estimated to be small.

Therefore, the fuel injection valve control device according to the embodiment corrects the voltage application time Tp, the gap time T2, and the holding current Ih based on detection results of the peak detection units 333 and 334.

Third Embodiment

The fuel injection valve control device according to the above-described embodiment corrects the voltage application time Tp, the gap time T2, and the holding current Ih. However, in a third embodiment, a gap time 12 and a holding current Ih are corrected.

Figure 10:
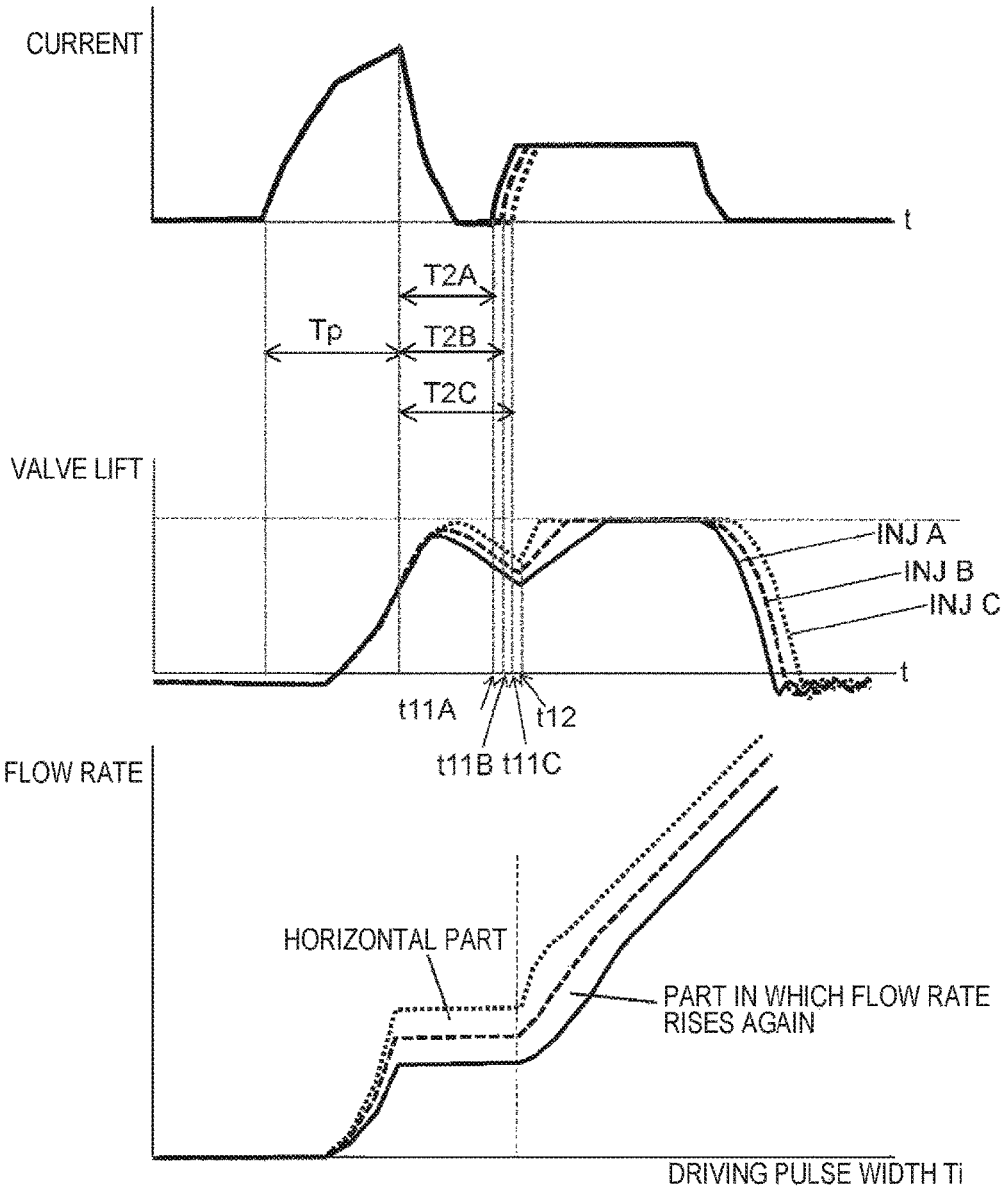
FIG. 10 indicates a time chart to correct a gap time and indicates injection amount characteristics of a fuel injection device.
Figure 11:
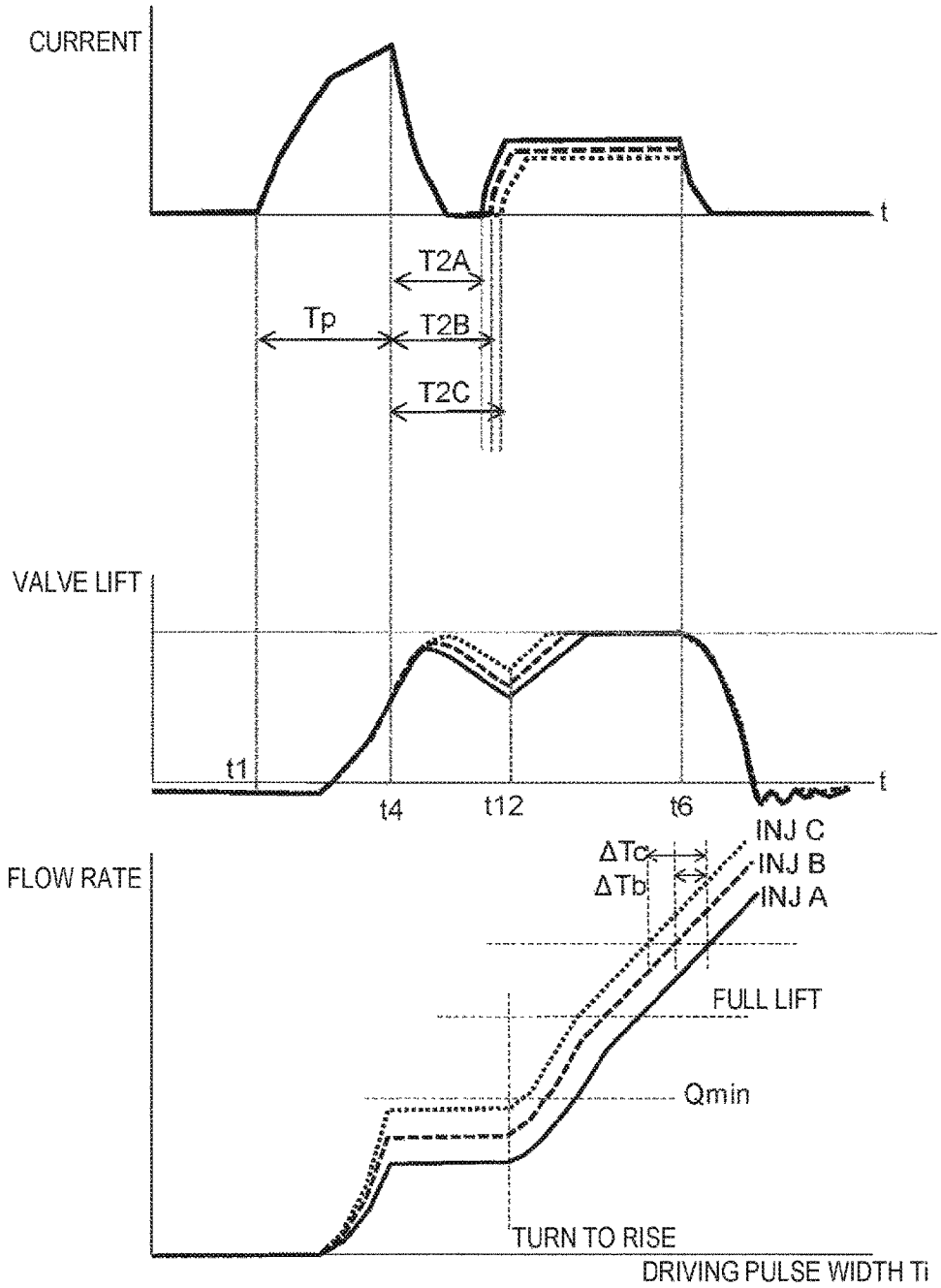
FIG. 11 indicates a time chart to correct a gap time and a holding current according to a third embodiment and indicates injection amount characteristics of a fuel injection device.

First, in the embodiment, a voltage application time Tp is not corrected. Therefore, flow rates with respect to a drive pulse width Ti are not matched. However, by correcting the gap time T2, as indicated in FIG. 10, timings when valve bodies 204 start to rise again are matched to a time t12. As a result, as indicated in the bottom diagram of FIG. 10, ranges from a horizontal part of an injection amount characteristic to a timing when a flow rate increases again are matched. Further, by correcting the holding current Ih, as indicated in FIG. 11, rising speeds (specifically, slopes) of the valve bodies 204 from the timing when the valve body 204 rises again to the timing when the valve body 204 is fully lifted are matched. In this manner, trends of a flow rate change with respect to the drive pulse width Ti of each fuel injection device can be matched.

In a part in which an injection amount is larger than the Qmin, flow rate characteristics of the INJ B and C are in parallel with a flow rate characteristic of the INJ A. At this time, when a drive pulse of the INJ C is extended for ΔTc, and a drive pulse of the INJ B is extended for ΔTb, a minimum flow rate can be reduced to the Qmin from a full lift.

The fuel injection valve control device according to the present invention is not limited to the above-described embodiments, and configurations thereof can be appropriately changed in a range not deviating from the gist of the present invention.

For example, in the above embodiments, when characteristics of the fuel injection device are determined, a set spring force is used. However, the set spring force is not necessarily used, and the characteristics of the fuel injection device may be determined on the basis of variability in operation times of valve bodies in the case where the same operation is performed. An example of an operation time of a valve body is a valve opening time from open to close. In this case, after a valve body is opened, without being fully lifted, the valve opening time in the case where the valve body is closed from a state of intermediate lift is preferably used. In this manner, in particular, variability caused by an elastic force of a set spring can be detected without considering tolerance of a housing. Further, as the other example of an operation time of a valve body, there is a method using a valve closing time. In this case, after drive voltage or drive current is turned off, a time until a valve body is actually seated is detected. This is because an elastic force of a set spring is most affected when a valve body is closed, and therefore it is suitable to detect a valve closing time to detect variability in the elastic force of a set spring.

REFERENCE SIGNS LIST

101 air cleaner
102 airflow sensor
103 throttle
104 collector
105 intake port
106 cylinder
111 fuel tank
112 low pressure pump
113 low pressure pipe
114 high pressure pump
115 high pressure pipe
116 fuel injection device
121 ignition plug
122 piston
123 connecting rod
201 housing
202 core
203 solenoid
204 valve body
205 anchor
206 valve seat
207 set spring
208 spring adjuster
209 nozzle hole
301 switch
302 switch
303 switch
304 shunt resistor
305 diode
306 diode
307 diode
308 diode
309 capacitor
310 boosting circuit
311 battery
312 switch control unit
321 reference memory
322 reference memory
323 reference memory
341 correction unit

342 correction unit
343 correction unit
331 differential unit
332 differential unit
333 peak search unit
334 peak search unit

The invention claimed is:

1. A fuel injection valve control device configured to control, by a drive pulse, a plurality of fuel injection devices, each comprising a valve body and a solenoid configured to open the valve body, wherein the fuel injection valve control device applies a boosting voltage to the solenoid to stop the solenoid and, after a prescribed time, applies a holding current, and the prescribed time and the holding current are corrected for each of the fuel injection devices so as to match ranges from a horizontal part of an injection amount characteristic indicating a relation between the drive pulse width and a flow rate to a timing when the flow rate increases again, based on a set spring force of the fuel injection device.

2. The fuel injection valve control device according to claim 1, wherein an application time of an initial boosting voltage is corrected for each of the fuel injection devices, based on the set spring force of the fuel injection device.

3. The fuel injection valve control device according to claim 1, wherein the set spring force of the fuel injection device is estimated based on, at least, either of an opening timing or a closing timing of the valve body.

4. The fuel injection valve control device according to claim 3, wherein the operating characteristic of the fuel injection device is detected based on a change in voltage or current, at least, either at the time of valve opening or the time of valve closing of the fuel injection device.

5. A fuel injection valve control device configured to control, by a drive pulse, a plurality of fuel injection devices, each comprising a valve body and a solenoid configured to open the valve body, wherein the fuel injection valve control device applies a boosting voltage to the solenoid to stop the solenoid and, after a prescribed time, applies a holding current, and among the fuel injection devices, ranges from a horizontal part of an injection amount characteristic indicating a relation between the drive pulse width and a flow rate to a timing when the flow rate increases again are matched by controlling the fuel injection device in which a closing timing of the valve body is fast such that the prescribed time becomes shorter, and the holding current value becomes larger, than the prescribed time and the holding current value of the fuel injection device in which the closing timing is slow.

6. A fuel injection valve control device configured to control, by a drive pulse, a plurality of fuel injection devices, each comprising a valve body, an elastic body configured to press the valve body to a valve seat, and a solenoid configured to open the valve body against a pressing force of the elastic body, wherein the fuel injection valve control device applies a boosting voltage to the solenoid to stop the solenoid and, after a prescribed time, applies a holding current, and among the fuel injection devices, ranges from a horizontal part of an injection amount characteristic indicating a relation between the drive pulse width and a flow rate to a timing when the flow rate increases again are matched by controlling the fuel injection device in which elasticity of the elastic body is large such that the prescribed time becomes shorter, and the holding current value becomes larger, than the prescribed time and the holding current value of the fuel injection device in which elasticity is small.

* * * * *